United States Patent [19]

Palsson

[11] 4,432,046

[45] Feb. 14, 1984

[54] PROTECTIVE CASING FOR A LAMP HOLDER

[76] Inventor: Johannes S. Palsson, Borganheidi 6, 810 Hveragerdi, Iceland

[21] Appl. No.: 435,339

[22] Filed: Oct. 19, 1982

[51] Int. Cl.[3] ..... F21V 15/00

[52] U.S. Cl. ..... 362/376; 362/158; 362/267; 362/378; 362/457; 362/253

[58] Field of Search ..... 362/376, 158, 267, 378, 362/457, 253

[56] References Cited

U.S. PATENT DOCUMENTS 3,175,079 3/1965 Giesler ..... 362/267

FOREIGN PATENT DOCUMENTS

| | | |
|---|---|---|
| 18,041 | 1902 | Sweden. |
| 825,995 | 1906 | Wheeler. |
| 1,161,454 | 1915 | Covit. |
| 338,154 | 1921 | West Germany. |
| 1,933,511 | 1933 | Manso. |
| 180187 | 1935 | Switzerland. |
| 1087690 | 1955 | France. |
| 857913 | 1961 | Great Britain. |
| 867631 | 1961 | Great Britain. |
| 1472498 | 1969 | West Germany. |
| 2174702 | 1974 | France. |

*Primary Examiner*—Stephen J. Lechert, Jr.
*Attorney, Agent, or Firm*—Holman & Stern

[57] ABSTRACT

A protective casing (20) for a lamp holder (10) for outdoor use comprises a cylindrical part (21) and a bowl-shaped base part (22) which are made of a relatively soft, elastic material and can be clamped axially together around an ordinary lamp holder (10). The engagement faces between the two parts are formed with radial recesses (27), which together form a hole for the lead-in of a cable and are dimensioned so that the cable is fixed upon the clamping. This provides a seal for the cable lead-in and also tension relief of the cable. Due to the clamping, a sealing ring (25) for the lamp (14, 15) is fixed between an end edge of the holder (10) and a rim flange (26) of the cylindrical part (21).

2 Claims, 2 Drawing Figures

PROTECTIVE CASING FOR A LAMP HOLDER

BACKGROUND OF THE INVENTION

1. Field of the Invention

This invention relates to protective casings for outdoor lamp holders that can be disassembled and still provide a good seal to protect the lamp against ingress of water and corrosion.

2. Description of the Prior Art

For outdoor use it is known to enclose lamp holders, e.g. for lamp festoons, in protective casings which are cast around the lamp holder and its lead-in wires, and to fit an elastic sealing ring between the bulb and the lamp holder so that the electrically conductive metallic parts of the lamp holder are protected against ingress of water, which might cause short-circuiting and corrosion. It is difficult or impossible to repair such a lamp holder because the interior parts are not accessible without damage to the lamp holder.

BRIEF SUMMARY OF THE INVENTION

The invention provides a protective casing for a lamp holder for outdoor use that can be disassembled and yet provides a good seal against ingress of water.

This object is achieved in that the protective casing comprises a substantially cylindrical part and a base part made of a relatively soft, elastic material and arranged to be clamped together around a lamp holder by a relative, axial movement and to thereby fix an elastic sealing ring between the edge of the lamp holder and an inwardly facing, annular flange on the substantially cylindrical part, and that cooperating recesses are provided in the engagement faces between the two parts for receiving a cable in such a manner that the defining faces of these recesses are pressed sealingly around the cable upon the clamping of the two parts. Such a casing can be used together with an ordinary lamp holder for outdoor use, and when the cylindrical part and the base part are clamped together, without being turned with respect to each other, an effective seal is provided both between two parts and between these and the lead-in wires. The clamping about these also makes special steps for tension relief superflous.

The protective casing is further characterized in that each of the recesses is semi-circular in cross-section, and this construction is especially adapted for use in connection with wires of a circular cross-section.

BRIEF DESCRIPTION OF THE DRAWING

The invention will be explained more fully below with reference to the accompanying drawing wherein.

DETAILED DESCRIPTION

Figure 1:
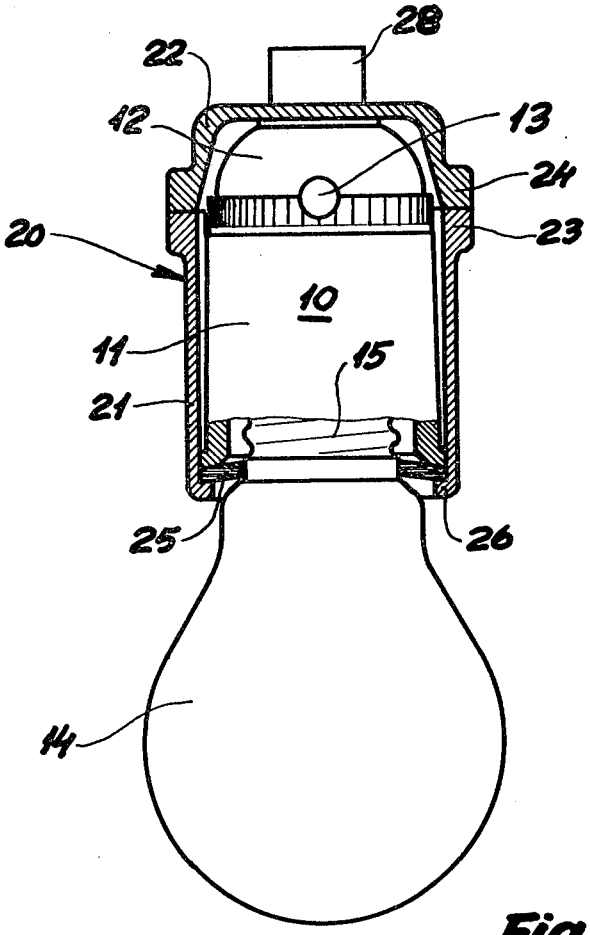
FIG. 1 is a longitudinal cross-sectional view showing an embodiment of the protective casing of the invention, in which a lamp holder with a bulb screwed into it is fitted.
Figure 2:
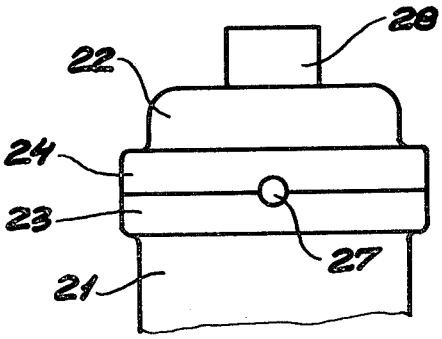
FIG. 2 is an elevational side view of a part of the protective casing of FIG. 1.

In FIG. 1, 10 represents a conventional lamp holder comprising a tube section 11, which is threaded (not shown) and a base member 12 which is screwed on to the threads of the tube section and contains electrodes to make contact with the threads and the central electrode of the lamp. A diametrical through hole 13 is drilled through the base member 12 for the lead-in of a festoon cable, from which the lamp holder is to be suspended and with which the electrodes of the base member are connected. A lamp 14 with a cap 15 is screwed into the lamp holder, as shown.

The lamp holder 10 is enclosed by a protective casing which is generally designated by 20 and comprises a cylindrical part 21 and a bowl-shaped base part 22, both made of a relatively soft, elastic material, e.g. rubber or plastics. The two parts 21 and 22 are both formed with a rim flange 23 and 24, respectively, whose engagement faces directed towards each other are slightly conical, which assists in making the joint completely tight when the two engagement faces are clamped together by means of screws, (not shown) which extend through plain, axial holes in one flange and into threaded holes in the other flange.

Due to this clamping, an elastic sealing 25 is clamped between the end edge of the tube section 11 of the lamp holder and an inwardly facing rim flange 26 on the outer end edge of the cylindrical part 21 of the protective casing 20. As appears from FIG. 1 the inner edge of the sealing ring 25 will sealingly engage the lamp cap 15.

Radial through-going recesses 27 of semi-circular cross-section, aligned with the hole 13 in the base member 12 of the lamp holder, are provided at two diametrically opposite locations in the engagement faces between the flanges 23 and 24. These recesses, in pairs, form cylindrical holes for receiving the cable which extends through the hole 13 and which has the dual function of supporting the lamp holder with the lamp and protective casing and of supplying power to the lamp. The recesses 27 are dimensioned so as to clamp the cable when the two parts 21 and 22 of the protective casing are clamped together, to thereby provide an effective seal for the cable leads and fix the cable in a manner that renders any other form of tension relief superfluous.

The base part 22 is, as shown, formed with an exterior lug 28, which may serve as a holding grip or for the mounting or suspension of the lamp or the like.

The protective casing 20 does not have to be constructed as shown in the drawing and described in the foregoing. It can of course be adapted for use together with other forms of lamp holders. Also, the clamping of the two parts can be effected in ways other than those described above, e.g. by means of loose clamping means.

I claim:

1. A protective casing for a lamp holder for outdoor use having a tubular section with an outer end into which a lamp cap is insertable, an inner end attached to a base member and diametrically oppositely extending lead-in cables, the casing comprising a substantially cylindrical part made of relatively soft, elastic material, a radially outwardly extending rim flange on one end of said cylindrical part, a radially inwardly extending annular flange on the other end of said cylindrical part, a dish-shaped base part made of relatively soft elastic material, a radially outwardly extending rim flange on the open end of said base part, cooperatively engaging sealing faces on said flanges, cooperating recesses in said engaging faces which when aligned with the lead-in cables for the lamp holder form openings through which the lead-in cables extend and are sealed therein, an elastic sealing ring extending between the inner surface of said radially inwardly extending annular flange and the outer surface of the lamp cap, and means to clamp said rim flanges together so that said cooperating faces are in sealing engagement with each other, said lead-in cables are sealed in said openings formed by said recesses and said sealing ring is sealingly compressed at its radially outer portion between said radially inwardly extending flange and the outer end of the lamp holder and at its radially inner portion against said outer surface of the lamp cap to seal the lamp holder within the casing.

2. A protective casing according to claim 1, wherein each of said recesses is semi-circular in cross-section.

* * * * *